US008485613B1

(12) United States Patent
Steffen et al.

(10) Patent No.: US 8,485,613 B1
(45) Date of Patent: Jul. 16, 2013

(54) CURIO CABINET WITH CONCEALED GUN RACK

(76) Inventors: Daniel W. Steffen, El Paso, IL (US); Darin M. Steffen, Roanoke, IL (US)

( * ) Notice: Subject to any disclaimer, the term of this patent is extended or adjusted under 35 U.S.C. 154(b) by 74 days.

(21) Appl. No.: 13/324,024

(22) Filed: Dec. 13, 2011

(51) Int. Cl.
*A47B 77/00* (2006.01)

(52) U.S. Cl.
USPC ..... 312/107; 312/120

(58) Field of Classification Search
USPC ..... 312/107, 114, 120, 123, 128, 129, 312/136, 204, 223.5, 238, 291, 326, 329, 312/351.1, 351.2; 206/315.1, 315.11, 317; 211/64
See application file for complete search history.

(56) References Cited

U.S. PATENT DOCUMENTS

| | | | | | |
|---|---|---|---|---|---|
| 1,756,984 | A | * | 5/1930 | Mason | 312/107 |
| 3,047,349 | A | * | 7/1962 | Powell | 312/287 |
| 3,848,940 | A | | 11/1974 | Berens | |
| 4,108,514 | A | * | 8/1978 | Zimmerman | 312/107 |
| D255,406 | S | * | 6/1980 | Stephens | D6/438 |
| 4,810,044 | A | * | 3/1989 | Dahnert | 312/223.5 |
| 5,048,901 | A | | 9/1991 | DeBlaay | |
| 5,180,222 | A | * | 1/1993 | Robinson | 362/125 |
| D340,595 | S | | 10/1993 | Jacquinot | |
| D343,970 | S | * | 2/1994 | Campbell | D6/437 |
| 5,681,100 | A | | 10/1997 | Powell | |
| 5,709,441 | A | * | 1/1998 | Bartling et al. | 312/107 |
| 5,730,513 | A | * | 3/1998 | Lemon et al. | 312/238 |
| 6,840,592 | B2 | * | 1/2005 | Kalieta et al. | 312/326 |
| 6,868,975 | B2 | * | 3/2005 | Sells et al. | 211/4 |
| 7,478,892 | B2 | * | 1/2009 | Punzel et al. | 312/322 |
| 2008/0122326 | A1 | * | 5/2008 | Johnson et al. | 312/249.1 |
| 2009/0195128 | A1 | * | 8/2009 | Harvey | 312/204 |
| 2009/0230826 | A1 | | 9/2009 | Myers | |

* cited by examiner

*Primary Examiner* — Darnell Jayne
*Assistant Examiner* — Matthew Ing
(74) *Attorney, Agent, or Firm* — Montgomery Patent & Design; Robert C. Montgomery

(57) ABSTRACT

A cabinet having a concealed gun rack is five-sided with a five-sided top panel. One (1) of the sides is a pivoting door. A pivoting mirrored structure is inside the cabinet and behind the door. When closed, mirrors obscure the depth of the cabinet. When open the mirrored structure allows access to a gun rack. Shelves attached to the mirrored structure can hold user selected objects.

15 Claims, 5 Drawing Sheets

CURIO CABINET WITH CONCEALED GUN RACK

RELATED APPLICATIONS

There are currently no applications co-pending with the present application.

FIELD OF THE INVENTION

The presently disclosed subject matter is directed towards gun racks. More specifically, the present invention is directed to gun racks concealed in mirrored cabinets.

BACKGROUND OF THE INVENTION

Gun owning and collecting are major interests to many Americans. Responsible owners of weapons, rifles, shotguns, handguns, knives, and the like typically keep their weapons locked and out of sight at all times. One (1) common way of doing this is to store the weapons in a gun rack, also known as a gun safe or gun cabinet.

Gun racks have proven to be very effective at storing weapons and at preventing accidental injuries. However, firearms are relatively expensive and a major gun collection can be worth significant money. The mere presence of a gun rack may alert others that firearms are present within a household. This can and has led to the theft of firearms.

Another problem with gun racks is that they tend to be rather large. Many households simply do not have available storage space in the house for a large gun rack in addition to the other furniture. Furthermore, while gun racks are useful, usually they are not particularly attractive furniture pieces (they can be however, usually at great cost). Therefore many gun racks are located within garages, basements, or other areas, which tend to make the contained firearms not readily available should quick access be required.

Accordingly, there exists a need for a way to safely and securely store firearms and other weapons without the disadvantages described above.

Curio cabinets are traditional pieces of furniture that are used to display cherished items. Such cabinets usually have ample shelving that can be versatility arranged. Curio cabinets are almost always "fine" furniture. That is, they are usually quality made from quality woods and other materials, they are given a superior finish, they are artistically pleasing to look at, and they usually improve the aesthetics of the room in which they are located. Curio cabinets often have features such as multiple beveled glass doors mounted on touch activated hinges, multiple glass shelves, quality interior lighting, and a polished exterior. While they are often rather tall and heavy, thus not easily moved, curio cabinets are almost always kept inside the home so that they and their contents can be appreciated.

Therefore, a technique of using a curio cabinet as a gun rack would be useful. Even more useful would be a technique of using a curio cabinet as a gun rack such that the weapons stored therein are readily available when needed. Beneficially, such a curio cabinet gun rack would hide the weapons from view and would not reveal to others that weapons were kept therein. Preferably, the depth of the curio cabinet would be obscured with mirrors.

SUMMARY OF THE INVENTION

The principles of the present invention provide for gun safes hidden in furniture. In particular, the principles of the present invention provide for mirrored cabinets having hidden gun racks.

A cabinet with a concealed gun rack in accord with the principles of the present invention has a top (half) with rectangular first and second rear panels that are affixed together along a common side edge, a rectangular first side panel that is affixed to the first rear panel along a common side edge, a rectangular second side panel that is fixed to the second rear panel along a common side edge, and a door frame that is pivotally attached to the first side panel using a door hinge. The door frame is dimensioned to span between the door hinge and a free side edge of the second side panel. The first and second rear panels, the first and second side panels, and the door frame form a first five sided perimeter that defines an interior region. Inside the interior region is at least one set of gun mounting hardware. A top panel is attached to the first and second rear panels and to the first and second side panels along common top edges. The top panel defines a second five sided perimeter that has sides parallel to the first five sided perimeter. A mirrored structure made from a rigid mirror backing has a first mirror panel that is attached to a first side of the mirror backing and a second mirror panel that is attached to a second side of the minor backing. The mirrored structure extends into the interior region. The mirrored structure is pivotally attached to the door hinge such that the door frame and the mirrored structure pivot independently. The mirrored structure is also dimensioned to span between the door hinge and the free side edge of the second side panel.

The foregoing structure provides for a hidden gun rack behind a cabinet because the mirrored structure hides the gun mounting hardware. Preferably, the first side panel is disposed opposite the second rear panel and the second side panel is disposed opposite the first rear panel. This forms a square with a cut-off corner. The gun mounting hardware can be used to mount a long gun (rifle) or a hand gun.

In practice the door frame will hold a transparent door window and will include a door handle (knob). Preferably, at least one (1) shelf will be visible through the door frame. The top panel can include a light for illuminating the shelf and can also include decorative crown molding. Preferably, the door hinge is a piano hinge that extends the entire height of the door frame.

The cabinet with concealed gun rack can also include a bottom panel beneath the first and second rear panels, the first and second side panels, and the door frame. Beneath the bottom panel may be a bottom section that has a perimeter shape similar to the first five sided perimeter. Preferably the bottom section includes at least one (1) door. The bottom panel can include a bottom transparent member and the bottom section can include a bottom light. The bottom light can pass through the bottom transparent member and illuminate the shelf. A switch can be used to selectively illuminate the bottom light.

A cabinet with a concealed gun rack preferably includes a latch that latches the mirrored structure closed. Beneficially, the mirrored structure is beveled so as not to contact the door frame when the door frame is closed.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
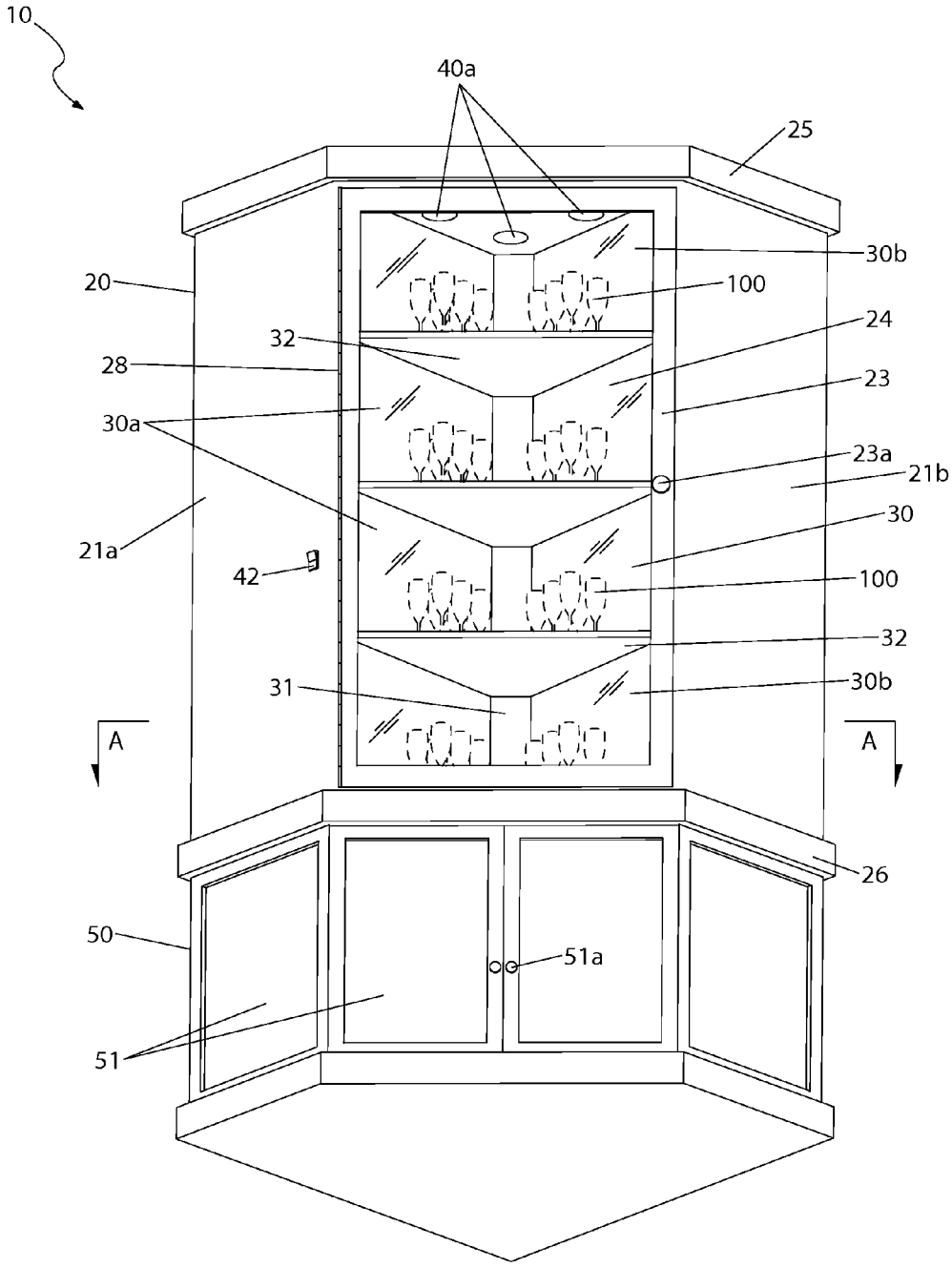
FIG. 1 is a perspective front view of a curio cabinet concealed gun rack 10 that is in accord with the principles of the present invention.

10 curio cabinet concealed gun rack
20 top half
21*a* left side panel
21*b* right side panel
22*a* left rear panel
22*b* right rear panel
23 door frame
23*a* door handle
24 window
25 top panel
26 bottom panel
28 door hinge
30 mirror frame
30*a* left mirror panel
30*b* right minor panel
30*c* tapered edge
30*d* door support
31 minor backing
32 shelf
35 minor lock
37 gun cabinet
37*a* long gun mounting hardware
37*b* handgun mounting panel
38 minor hinge
40*a* top light
40*b* bottom light
42 light switch
50 bottom half
51 bottom door
51*a* bottom door handle
100 decorative object
110 firearm

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The presently disclosed subject matter now will be described more fully hereinafter with reference to the accompanying drawings in which one preferred embodiment is shown. However, it should be understood that this invention may take many different forms and thus should not be construed as being limited to the specific embodiment set forth herein. In the figures like numbers refer to like elements throughout. Additionally, the terms "a" and "an" herein do not denote a limitation of quantity, but rather denote the presence of at least one of the referenced items.

The principles of the present invention provide for a curio cabinet with concealed gun rack 10 that is used both for displaying items and for storing firearms 110 in a concealed gun rack. The curio cabinet with concealed gun rack 10 appears to be a curio-style cabinet having a plurality of shelves 32 and doors 23 (referred to herein as a door frame) and 51 for storage and display. However, the curio cabinet with concealed gun rack 10 also includes a gun cabinet 37 for storing a plurality of firearms 110 inside a top half 20 of the curio cabinet with concealed gun rack 10. The gun cabinet 37 is normally concealed and its presence is not readily apparent to a casual passerby.

FIG. 1 shows a perspective front view of the curio cabinet with concealed gun rack 10 which includes the top half (or section) 20 and a bottom half (or section) 50. The top half 20 has left and right side panels 21*a*, 21*b*, left and right rear panels 22*a* (see FIG. 4), 22*b* (see FIG. 5), a door frame 23, a window 24 within the door frame 23, a top panel 25, and a bottom panel 26.

Figure 5:
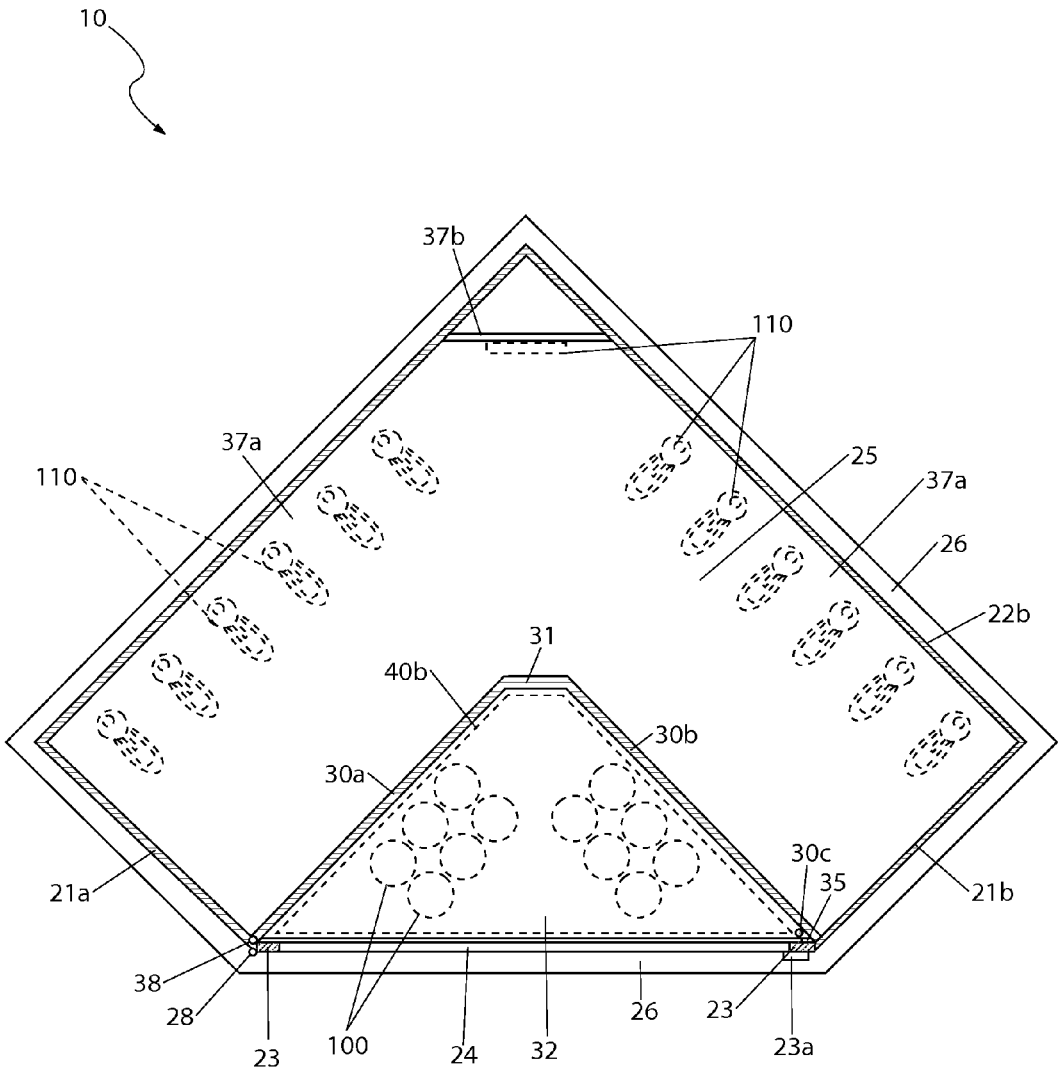

The left and right side panels 21*a*, 21*b*, left and right rear panels 22*a*, 22*b*, and door frame 23 form a five (5) sided perimeter which is effectively a square with one (1) corner cut off (see FIG. 5). This shape enables the curio cabinet with concealed gun rack 10 to be utilized in a corner location within a house or other building while still providing wide angle viewing of decorative objects 100 in the curio cabinet with concealed gun rack 10 and ready access to firearms 110 stored within.

The left and right rear panels 22*a*, 22*b* are rectangular panels that are perpendicularly affixed to each other along a common side edge. In the preferred embodiment the left and right rear panels 22*a*, 22*b* are each thirty-three inches (33 in.) wide.

Referring now primarily to FIGS. 1 and 5, the left side panel 21*a* is a rectangular panel of the same height as the left rear panel 22*a*, and it is perpendicularly affixed to the left rear panel 22*a* along a common side edge. The left side panel 21*a* is disposed opposite the right rear panel 22*b* (FIG. 5) but has a shorter width than the right rear panel 22*b*. The right side panel 21*b* is of the same dimensions and attains a mirrored orientation to the left side panel 21*a*. The right side panel 21*b* is perpendicularly affixed to the right rear panel 22*b* along a common side edge. In the preferred embodiment, the side panels 21*a*, 21*b* are each fourteen inches (14 in.) wide.

Referring now to FIG. 1, the door frame 23 is a rectangular frame of similar height as the left side panel 21*a* and right side panel 21*b*. The door frame 23 is situated between the near side edges of side panels 21*a*, 22*b* and has a width corresponding to the distance between those edges. The door frame 23 is connected by an elongated door hinge 28 to an adjacent front edge of the left side panel 21*a*. The door hinge 28 is preferably a piano hinge that extends the entire height of the common edge. On the side of the door frame 23 opposite the door hinge 28 is a door handle 23*a*.

Affixed in the door frame 23 is a transparent window 24. The window 24 is preferably a rectangular glass pane which provides a clear view of decorative objects 100 stored within the curio cabinet with concealed gun rack 10 when the door frame 23 is closed.

The top panel 25 is a flat, horizontal panel with a perimeter shape similar to but larger than the perimeter shape formed by the side panels 21*a*, 21*b*, rear panels 22*a*, 22*b*, and door frame 23. The top panel 25 is affixed to the top edge of the side panels 21*a*, 21*b* and rear panels 22*a*, 22*b* but is not connected to the door frame 23. The top panel 25 preferably comprises a decorative crown molding along its perimeter.

The curio cabinet with concealed gun rack 10 beneficially has a plurality of electrical top lights 40*a* that are recessed within a lower surface of the top panel 25. The top lights 40*a* are preferably a plurality of fluorescent or halogen lights powered by connection to a residential electrical power supply. The curio cabinet with concealed gun rack 10 also beneficially has a bottom light 40*b* that is recessed within a top surface of the bottom panel 26. The bottom light 40*b* preferably is a halogen or fluorescent light that is covered by a transparent or translucent plastic surface which is flush with the top of the bottom panel 26 so as to provide a flat, continuous surface within the bottom of the top half 20. In the preferred embodiment, the bottom light 40*b* comprises a triangular surface of similar size and shape to a shelf 32 of the curio cabinet with concealed gun rack 10.

The top lights 40*a* and bottom lights 40*b* are turned on or off using a light switch 42 located on an exterior surface of the curio cabinet with concealed gun rack 10. In the preferred embodiment, the light switch 42 is located on the left side panel 21*a*. The light switch 42 is in electrical communication with the top lights 40*a* and bottom lights 40*b* via internal electrical wiring routed through the left side panel 21*a* and top panel 25. The top lights 40*a* and bottom lights 40*b* are selectively illuminated to light decorative objects 100 stored within the curio cabinet with concealed gun rack 10 and to light firearms 110 hidden within the curio cabinet with concealed gun rack 10.

The bottom panel 26 is a flat, horizontal panel of similar size and shape to the top panel 25. The bottom panel 26 is affixed to the bottom edges of the side panels 21*a*, 21*b* and rear panels 22*a*, 22*b* but is not connected to the door frame 23. The bottom panel 26 is further affixed atop the bottom half 50 of the curio cabinet with concealed gun rack 10.

In the preferred embodiment, the left and right side panels 21*a*, 21*b*, left and right rear panels 22*a*, 22*b*, door frame 23, top panel 25, and bottom panel 26 are constructed from fine wood coated with high quality stain and protective coating.

The bottom half 50 of the curio cabinet with concealed gun rack 10 is a cabinet with a perimeter shape similar to the top half 20. The bottom half 50 has a plurality of bottom doors 51 each having a bottom door handle 51*a*. The bottom half 50 has a hollow interior that can be accessed by opening the bottom doors 51 with the bottom door handles 51*a* in a common manner. The bottom half 50 is used to store a plurality of desired objects 100 and can be utilized to store firearm accessories used with the firearms 110 hidden in the top half 20 of the curio cabinet with concealed gun rack 10. In the preferred embodiment, the bottom half 50 is constructed from similar materials as the top half 20.

It may be appreciated that the curio cabinet with concealed gun rack 10 can have desirable aesthetic and material features and design common for fine furniture, such as decorative trim, inlaid patterns, and ornate woodworking, various finishing treatments, varnishes, paints, and the like providing color and protection to the curio cabinet with concealed gun rack 10.

Figure 2:
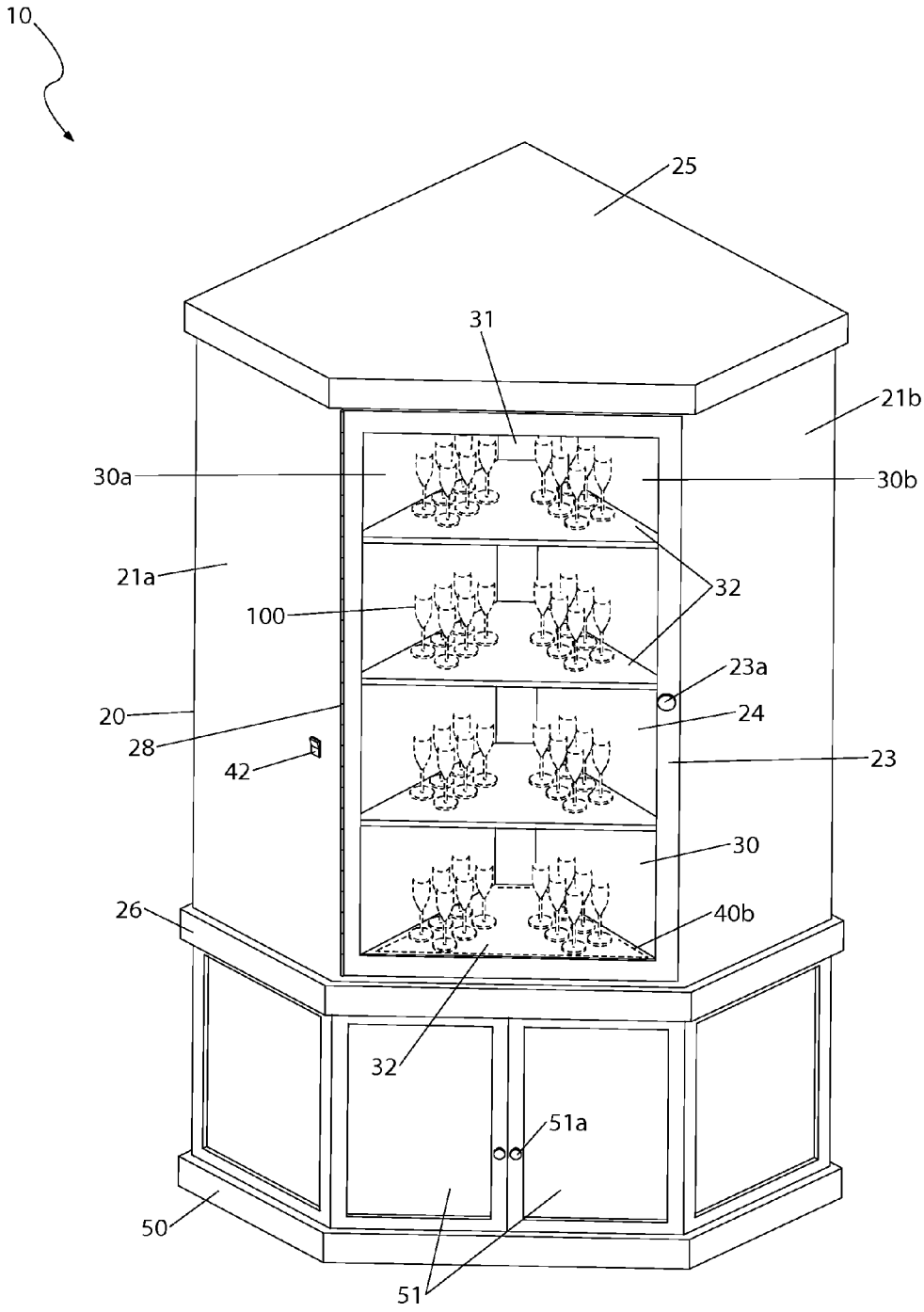
FIG. 2 is a front perspective view of the curio cabinet concealed gun rack 10 illustrated in FIG. 1.

FIG. 2 shows a downward perspective front view of the curio cabinet with concealed gun rack 10. The curio cabinet with concealed gun rack 10 has a plurality of interior shelves 32 that are visible through the window 24. The shelves 32 support for display a plurality of decorative objects 100 selected by a user. In the preferred embodiment, the shelves 32 have an isosceles trapezoid shaped. A front edge of each shelf 32 corresponds in width to the width of the door frame 23 and abuts the door frame 23. The side edges of each shelf 32 extend perpendicularly inward from adjacent side panel 21*a*, 21*b*. Each shelf 32 is connected to a mirror frame 30 along a left edge, a right edge, and a rear edge. The shelves 32 can be connected utilizing common permanent fasteners such as an adhesive, brackets and screws, or the like, or can be set upon brackets similarly to bookshelves.

In a preferred embodiment, the shelves 32 are constructed from glass or a transparent or translucent plastic material such that the light from the top lights 40*a* and the bottom light 40*b* can illuminate from both directions.

A minor panel 30 includes a left minor panel 30*a*, a right minor panel 30*b*, and a minor backing 31, all being mirrored surfaces. The minor panel 30 has a height corresponding to the height of the door frame 23. The minor backing 31 is affixed to a common side edge of each of the mirror panels 30*a*, 30*b* and provides structural support to the minor panels 30*a*, 30*b* and the shelves 32.

As noted the front surface of each minor panel 30*a*, 30*b* is a minor. The minor panels 30*a*, 30*b* serve to visually conceal the space behind the minor panels 30*a*, 30*b* where firearms 110 are stored. The minor surfaces of the minor panels 30*a*, 30*b* further reflect light from the lights 40*a* and the image of decorative objects 100 in a manner which is aesthetically pleasing and which obscures the true depth of the interior of the curio cabinet with concealed gun rack 10. The obscured depth makes it less likely that a casual passerby will realize that there is relatively deep space behind the minor panels 30*a*, 30*b*.

The minor panels 30*a*, 30*b*, minor backing 31, and shelves 32 are not attached to the top panel 25, bottom panel 26, or right side panel 21*b*. The minor frame 30 is attached to the left side panel 21*a* along a common edge of the left minor panel 30*a* with a minor hinge 38 (see FIG. 5).

Figure 3:
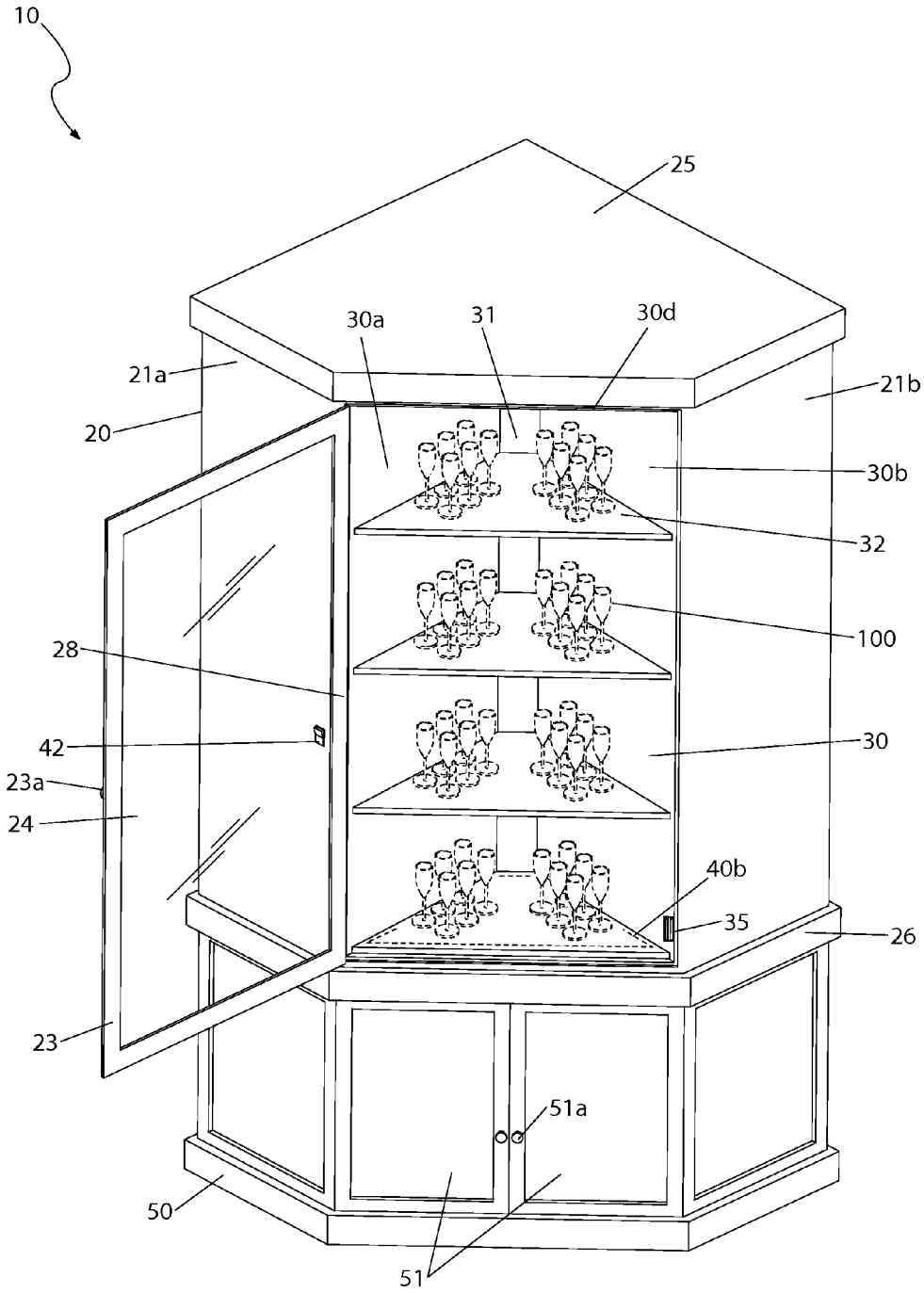
FIG. 3 is a front perspective view of the curio cabinet concealed gun rack 10 illustrated in FIGS. 1 and 2, but with a door frame 23 opened.

FIG. 3 shows a perspective front view of the curio cabinet with concealed gun rack 10 with the door frame 23 in an open position. The door hinge 28 (see FIG. 1) allows the door frame 23 and window 24 to swing open outwardly from the curio cabinet with concealed gun rack 10. The door handle 23*a* (see FIG. 1) opposite the door hinge 28 assists a user in opening the door frame 23. Opening the door frame 23 allows the user to access the shelves 32 to access decorative objects 100.

When the door frame 23 is open, the user can access a minor lock 35 that is located between an interior bottom portion of the right mirror panel 30*b* and the bottom panel 26. The minor lock 35 is a mechanical lock that, when locked, prevents the minor frame 30 from opening by preventing horizontal motion of the right minor panel 30*b* relative to the bottom panel 26. The minor lock 35 prevents uninformed users from accidentally opening the minor frame 30 and accessing the gun cabinet 37. In at least one (1) embodiment, the minor lock 35 is a two-position slide lock such as commonly utilized with home doors, with a bolt affixed to the right minor panel 30*b* and engaging an aperture within the bottom panel 26. In at least one (1) other embodiment, the minor lock 35 is a rotating curvilinear latch that engages the bottom panel 26 when rotated to prevent opening of the minor frame 30. However, it can be appreciated that other locking mechanisms such as latches, deadbolts, padlocks, spring-loaded bolts, magnetic latches, and the like can be utilized with similar effect.

Figure 4:
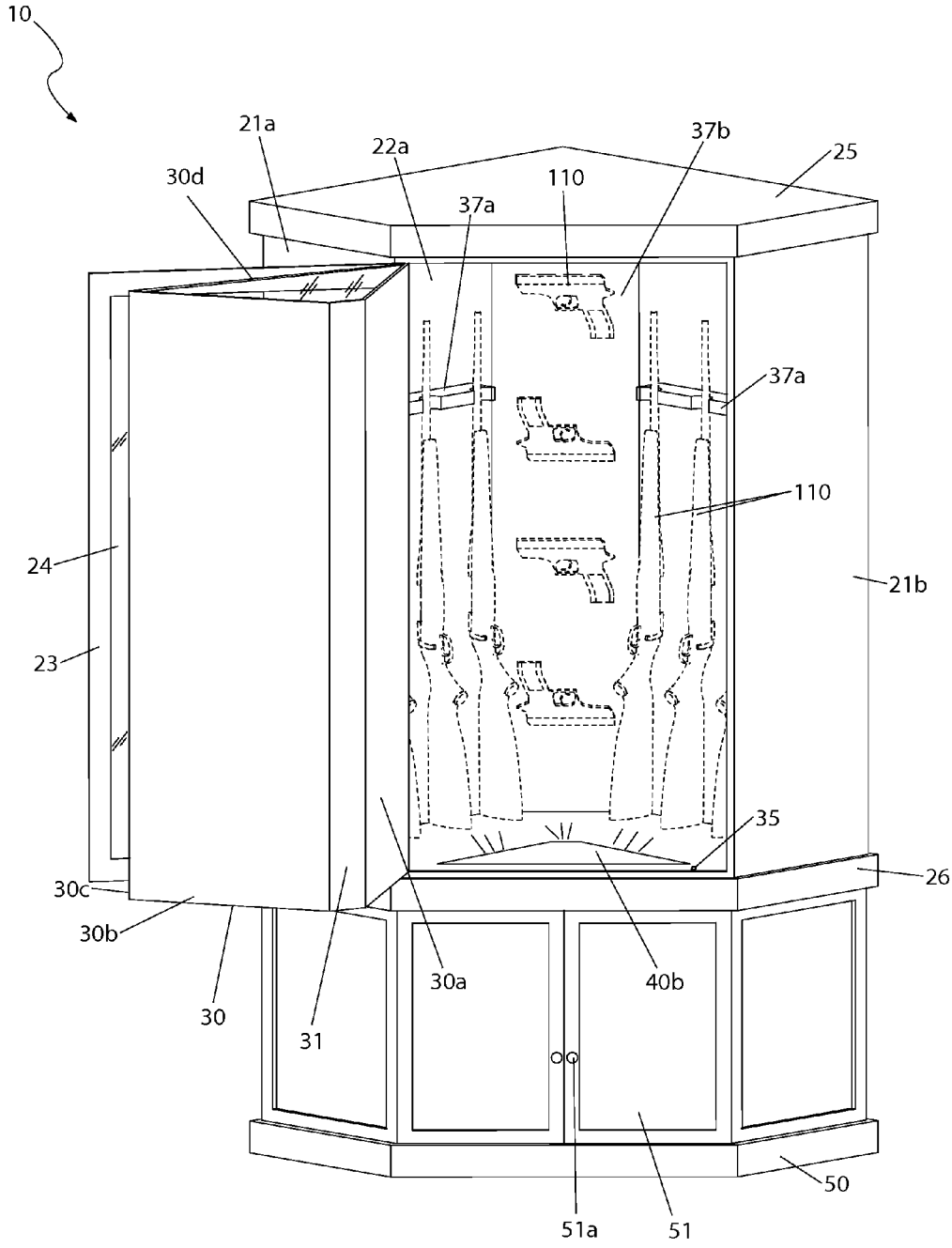
FIG. 4 is a perspective front view of the curio cabinet concealed gun rack 10 illustrated in FIGS. 1, 2, and 3, but with a mirror frame 30 opened; and, FIG. 5 is a cross-sectional view of the curio cabinet concealed gun rack 10 taken along line A-A of FIG. 1.

FIG. 4 shows a perspective front view of the curio cabinet with concealed gun rack 10 with the minor frame 30 open and the gun cabinet 37 exposed. When the minor lock 35 is unlocked, the minor frame 30 and shelves 32 can be rotated outwardly from the curio cabinet with concealed gun rack 10 in a similar motion to the door frame 23 in order to expose the gun cabinet 37 and stored firearms 110. The gun cabinet 37 is the area between the minor frame 30 and rear panels 22*a*, 22*b*. The gun cabinet 37 includes long gun mounting hardware 37*a* and a handgun mounting panel 37*b* that are used to organize and retain a plurality of firearms 110 and to prevent them from accidentally falling or moving.

The long gun mounting hardware 37*a* is shown in FIG. 4 as being a pair of notched gun racks. The handgun mounting panel 37*b* comprises a flat panel covering a rear corner of the gun cabinet 37 and oriented parallel to the front of the top half 20. The handgun mounting panel 37*b* is preferably a wood panel spanning from the top panel 25 to the bottom panel 26 and providing a surface for the installation of handgun pegs or similar hardware that can be utilized to securely retain a plurality of handguns 110.

The minor frame 30 also includes a door support 30*d* that is integrally attached to a top front corner of the left mirror panel 30*a* and to a top front corner of the right minor panel 30*b*. The door support 30*d* supports a top of the door frame 23 when it is in a closed position.

A rear surface of the left mirror panel 30*a* and a rear surface of the right minor panel 30*b* (behind the minors) comprise a strong, durable material which supports and stiffens the door frame 23 and prevents the door frame 23 from sagging. In at least one (1) embodiment, the rear surface of the left mirror panel 30*a* and the rear surface of the right mirror panel 30*b* include a plurality of steel cross-supports along the back side of the mirror.

It is understood that various firearm mounting hardware such as locking gun racks, pistol hooks, ammunition shelves, vertical pistol racks, and the like can be used with similar effect and as thus should not be interpreted as a limiting factor of the present disclosure.

FIG. 5 shows a cross-sectional view of the curio cabinet with concealed gun rack 10 taken along line A-A of FIG. 1. The line A-A is parallel to the top surface of the bottom panel 26 at a height just above the lowest shelf 32, and the view is directed perpendicularly downward. The right mirror panel 30*b* has a tapered side edge 30*c* opposite the minor backing 31 which provides clearance between the right minor panel 30*b* and the adjacent right side panel 21*b* during opening. This allows the front edge of the right minor panel 30*b* to touch the right side panel 21*b* when closed to give the illusion that there is nothing behind the right minor panel 30*b*, while still allowing the minor panels 30*a*, 30*b* to hinge open without bumping into the right side panel 21*b*.

It is envisioned that other styles and configurations can be easily incorporated into the teachings of the present disclosure and only one particular configuration has been shown and described for purposes of clarity and disclosure and not by way of limitation of scope.

In accordance with the principles of the present invention, the preferred embodiment can be utilized by the user in a simple and effortless manner with little or no training. A user obtains a model of the curio cabinet with concealed gun rack 10 having a desired material construction, size, shape, gun cabinet 37 configuration, and aesthetic appearance. The user places the curio cabinet with concealed gun rack 10 at a desired location such as at a corner of a room. The user opens the door frame 23 using the door handle 23*a* and places a desired plurality and variety of decorative objects on the shelves 32. The user can further unlock the mirror lock 35 and open the mirror frame 30 to access the gun cabinet 37. The user then stores a desired plurality and variety of firearms 110 and associated accessories within the gun cabinet 37. Once the firearms 110 are stored, the mirror frame 30 is closed and the mirror lock 35 locked to prevent the gun cabinet 37 from accidentally becoming exposed. The door frame is shut 23 and the decorative objects 100 can be viewed through the window 24. The reflections of the decorative objects 100 within the mirror panels 30*a*, 30*b* make it difficult for a casual passerby to accurately assess the depth of the shelves 32 as compared to the overall size of the curio cabinet with concealed gun rack 10 and make it unlikely that a passerby will recognize the presence of the gun cabinet 37. The user can selectively turn the lights 40*a*, 40*b* on and off using the light switch 42 to illuminate the shelves 32 for viewing or to illuminate the gun cabinet 37 when accessing the firearms 110. The user can further store any desired plurality and variety of objects including firearm accessories or ammunition within the bottom half 50 of the curio cabinet with concealed gun rack 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cabinet with a concealed gun rack, comprising:

a top having rectangular first and second rear panels affixed along a common side edge, a rectangular first side panel affixed to said first rear panel along a common side edge, a rectangular second side panel affixed to said second rear panel along a common side edge, and a door frame pivotally attached to said first side panel using a door hinge, said door frame dimensioned to span between said door hinge and a free side edge of said second side panel, wherein said first and second rear panels, said first and second side panels, and said door frame form a first five sided perimeter that defines an interior region;

a top panel attached to said first and second rear panels and to said first and second side panels along common top edges, said top panel defining a second five sided perimeter having sides parallel to said first five sided perimeter and further including a bottom panel beneath said first and second rear panels, said first and second side panels, and said door frame;

a bottom section beneath said bottom panel, said bottom section having a perimeter shape similar to said first five sided perimeter, said bottom section further including at least one door;

at least one gun mounting hardware fixed inside said interior region;

a mirrored structure comprised of a rigid minor backing, a first mirror panel affixed to a first side of said mirror backing, and a second mirror panel affixed to a second side of said mirror backing; and at least one shelf mounted on said mirrored structure visible through said door frame;

wherein said bottom panel is affixed to bottom edges of said first and second rear panels and said first and second side panels;

wherein said mirrored structure hides said at least one gun mounting hardware;

wherein said mirrored structure extends into said interior region;

wherein said mirrored structure is pivotally attached to said door hinge such that said door frame and said mirrored structure pivot independently; and, wherein said mirrored structure is dimensioned to span between said door hinge and said free side edge of said second side panel.

2. A cabinet with a concealed gun rack according to claim 1 wherein said first side panel is disposed opposite said second rear panel.

3. A cabinet with a concealed gun rack according to claim 2 wherein said second side panel is disposed opposite said first rear panel.

4. A cabinet with a concealed gun rack according to claim 1, further including a door window in said door frame.

5. A cabinet with a concealed gun rack according to claim 1 wherein said top panel includes decorative crown molding along second five sided perimeter.

6. The cabinet with a concealed gun rack according to claim 1 wherein said first five sided perimeter is a square having one cut-off corner.

7. The cabinet with a concealed gun rack according to claim 1 wherein said at least one gun mounting hardware is configured to mount a long gun.

8. The cabinet with a concealed gun rack according to claim 1 wherein said at least one gun mounting hardware is configured to mount a hand gun.

9. A cabinet with a concealed gun rack according to claim 1, wherein said top panel includes a light for illuminating said at least one shelf.

10. The cabinet with a concealed gun rack according to claim 1 wherein said door hinge is a piano hinge that extends the entire height of the door frame.

11. The cabinet with a concealed gun rack according to claim 1, wherein said door frame has a door handle and a side opposite said door hinge.

12. A cabinet with a concealed gun rack according to claim 1, wherein said bottom panel includes a bottom transparent member, wherein said bottom section includes a bottom light, and wherein said bottom light can pass through said bottom transparent member and illuminate said shelf.

13. A cabinet with a concealed gun rack according to claim 12, further include a switch for selectively illuminating said bottom light.

14. A cabinet with a concealed gun rack according to claim 1, wherein said top includes a latch to latch said mirrored structure closed.

15. A cabinet with a concealed gun rack according to claim 14, wherein said mirrored structure is beveled so as not to contact said door frame when said door frame is closed.

* * * * *